United States Patent [19]

Gahler et al.

[11] 4,030,928

[45] June 21, 1977

[54] PROCESS OF SENSITIZING SILVER HALIDE EMULSION WITH A DITHIOESTER

[75] Inventors: Siegfried Gahler, Wolfen; Karl-Wilhelm Junge, Dessau; Gunther Fischer, Leipzig; Steffen Scheithauer; Horst Viola, both of Dresden, all of Germany

[73] Assignee: VEB Filmfabrik Wolfen-Fotochemisches Kombinat, Wolfen, Germany

[22] Filed: Nov. 18, 1975

[21] Appl. No.: 632,936

[52] U.S. Cl. ..... 96/107
[51] Int. Cl.[2] ..... G03C 1/28
[58] Field of Search ..... 96/107

[56] References Cited

UNITED STATES PATENTS

| | | | |
|---|---|---|---|
| 3,320,069 | 5/1967 | Illingsworth | 96/107 |
| 3,597,210 | 8/1971 | Bigelow | 96/107 |

*Primary Examiner*—Won H. Louie, Jr.
*Attorney, Agent, or Firm*—Nolte and Nolte

[57] ABSTRACT

Method for increasing the sensitivity of a photographic silver halide-gelatin emulsion comprising at the beginning of the chemical ripening adding to the emulsion of a dithioester of the formula:

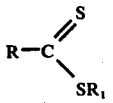

in which R is alkyl, α-hydroxyalkyl, α-hydroxyaralkyl, condensed aryl, or o- or p-substituted phenyl or α-naphthyl, the o- or p- located substituent being a F, OH, dialkylamino, sulfo, phenyl, phenylazo or anilidocarbonyl group and $R_1$ is alkyl or aralkyl.

5 Claims, No Drawings

PROCESS OF SENSITIZING SILVER HALIDE EMULSION WITH A DITHIOESTER

The present invention relates to a method for increasing the sensitivity of photographic silver halide-gelatin emulsions during the chemical ripening.

It is well known that the chemical ripening is a very important step in the preparation of photographic emulsions. It determines the final properties of the emulsions. The sensitivity can be increased by the addition of certain materials, such as sulfur sensitizers, reducing agents, or compounds of precious metals. Thus, for a long time, sulfur sensitizers, e.g., sodium thiosulphate and derivatives of thiourea, have been used. It has also been proposed to use disulfides, thioether, thioamides or derivatives of dithiocarbamic acid.

All these compounds, though, have the basic disadvantage that their action is very feeble, that the increases in sensitivity are accompanied by fogging, particularly in the case of the thioureas and the derivatives of dithiocarbamic acid, or that the result can only be attained in a very narrow range of pH or pAg.

It is an object of the present invention to increase the sensitivity of photographic silver halide-gelatin emulsions without an increase in fogging.

It is a further object of the present invention to provide better chemical sensitizers.

Other objects and advantages of the present invention will be apparent to one skilled in the art from the following description of the invention.

According to the present invention, at the beginning of the chemical ripening there is added to the gelatin-silver halide emulsion a dithioester of the general formula:

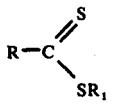

in order to increase the sensitivity of the emulsion.

In the above formula, R is an alkyl, preferably methyl up to pentyl, i.e., $C_1$ to $C_5$, α-hydroxy-alkyl, in which the alkylene residue is preferably $C_1$ to $C_5$, α-hydroxy-aralkyl, in which the alkylene residue is preferably $C_1$ to $C_5$ and the aryl residue is preferably phenyl, condensed aryl, preferably α-naphthyl or fluorenyl-3-, o- or p- substituted phenyl or α-naphthyl, in which the o- or p- located substituents may be F, OH, dialkylamino-, in which the alkyl groups are preferably $C_1$ to $C_5$, sulfo, phenyl-, phenylazo, or anilidocarbonyl-groups; and $R_1$ is an alkyl, preferably $C_1$ to $C_5$, or aralkyl, preferably benzyl.

The amounts to be used of the substances of the present invention are 0.5 to 50 mg. per mol of silver halide and may be used in addition to sensitization with precious metals.

The increase in sensitivity is particularly noticeable when silver chloride-bromide emulsions, containing at most 50 mol% silver bromide, are worked up with gelatin which is low in impurities. Herein, a gelatin is defined as being low in impurities if it contains an extremely low level of photographically active compounds such as sulfur compounds or reducing agents, and also preferably no inhibitors.

The dithiocarboxylic acid esters of the present invention may be prepared, as is well known, as follows: by the reaction of Grignard compounds with $CS_2$ and alkylation of the dithioacid salts with dialkylsulfates (see, e.g., J. Houben and K. M. L. Schultze, Ber. Dtsch. Chem. Ges. 43, 2482 (1910); R. Mayer, S. Scheithauer and D. Kunz, Chem. Ber. 99, 1393 (1966); or by the reaction of nitriles with mercaptans and HCl to iminothioether-hydrochlorides and the reaction thereof with $H_2S$ (see C. S. Marvel, P. de Radzitzky and J. J. Brader, J. Am. Chem. Soc. 77, 5997, 1955; R. Mayer, S. Scheithauer and D. Kunz, loc. cit.); or by the reaction of phenols with $CS_2$ or with chlorodithiocarboxylic acid esters (H. Viola and R. Mayer, German Democratic Republic Pat. No. 67,119, June 5, 1969 and German Democratic Republic Pat. No. 64,062, October 5, 1968); or in the case of arylazo derivatives of aromatic dithiocarboxylic acid esters, by the introduction of the arylazo group by means of aromatic diazonium salts; or in the case of α-hydroxy-fatty acid- or aryl-fatty acid-dithio-carboxylic acid esters, by the reaction of cyanohydrins with mercaptans and HCl and the reaction of the thus produced α-hydroxy-iminothioether hydrochloride with $H_2S$.

The present invention has the advantage that, compared with silver halide-gelatin-emulsions sensitized only with gold, the sensitivity of the emulsions is increased by twice as much.

Compared with the usually used sensitization with sodium thiosulfate, an increase on the average of about 0.15 log. sensitivity units is observed.

The invention will now be further described by reference to the following example, which is intended to illustrate but not limit the invention.

EXAMPLE

A silver chloride-bromide emulsion of 14.3 mol% silver bromide is divided prior to chemical ripening into nine parts of 1 kg., each which is marked with a respective one of the letters from A to I. The emulsion was prepared using a gelatin, low in impurities and the usual preparation steps: addition of silver halide, physical ripening, solidification, diluting down to a conductivity of $1800 \times 10^{-6}\ \Omega^{-1}\ cm^{-1}$.

To A only a gold salt is added as a chemical sensitizer; to the other samples also the following substances are added:

B 2 mg. α-hydroxy-dithio-isobutyric acid ethyl ester
C 2 mg. α-ethyl-α-hydroxy-dithio-n-butyric acid-ethyl ester
D 5 mg. of the same compound as in C
E 2 mg. cyclohexanol-1-dithio-carboxylic acid ethyl ester
F 2 mg. α-hydroxy-α-methyl-dithiophenyl acetic acid ethyl ester
G 2 mg. O-(p-dithiocarbethoxyphenyl)-N-phenylurethane
H 2 mg. fluorene-3-dithiocarboxylic acid ethyl ester
I 2.5 mg. sodium thiosulfate.

Chemical ripening lasts 120 minutes at 54° C. The samples of the emulsions are poured onto glass plates, exposed, and developed for 5 minutes in a developing bath of the following composition:

1.5 g. N-methyl-p-aminophenyl-sulfate
18 g. sodium sulfite
2.5 g. hydroquinone
18 g. potassium carbonate 1 g. potassium bromide, dissolved in distilled water to a volume of 1 liter.

After fixing and drying, the sensitometry of the plates exhibits the following values, which distinctly demonstrate that the added substances increase the sensitivity and the contrast:

| Sample | Fogging | $E_{0.1}$ [x)] | $E_{1.0}$ | $\gamma$ |
|---|---|---|---|---|
| A | 0.27 | 9.0 | 7.3 | 3.3 |
| B | 0.27 | 10.0 | 8.6 | 5.2 |
| C | 0.25 | 9.7 | 8.5 | 7.0 |
| D | 0.25 | 10.3 | 9.1 | 5.8 |
| E | 0.29 | 9.7 | 8.3 | 4.5 |
| F | 0.20 | 9.3 | 8.3 | 6.0 |
| G | 0.30 | 10.1 | 8.9 | 6.0 |
| H | 0.25 | 9.8 | 8.6 | 5.9 |
| I | 0.23 | 9.2 | 8.0 | 3.8 |

[x)] $E_{0.1}$ and $E_{1.0}$ signify that the sensitivity was determined by the optical density 0.1 or 1.0 from the characteristic curve through the fog. The sensitivity numbers correspond to powers of 2, so that a difference of 1 indicates double or half the sensitivity.

What is claimed is:

1. Method for increasing the sensitivity of a photographic silver halide-gelatin emulsion which is chemically ripened comprising at the beginning of the chemical ripening adding to the emulsion a dithioester of the formula

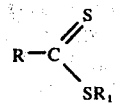

in which R is alkyl, α-hydroxyalkyl, α-hydroxyaralkyl, phenyl fluorenyl-3- or o- or p-substituted phenyl or α-naphthyl, the o- or p- located substituents being a F, OH, dialkylamino, sulfo, phenyl, phenylazo or anilidocarbonyl group and $R_1$ is alkyl or aralkyl in the proportion of about 0.5 to 50 mg. dithioester sensitizer per mole silver halide.

2. A method in accordance with claim 1 wherein the sensitizer is the ethylester of α-ethyl-α-hydroxy-dithio-n-butyric acid.

3. A method in accordance with claim 1 wherein the sensitizer is cyclohexanol-1-dithio-carboxylic acid ethylester.

4. A method in accordance with claim 1 wherein the sensitizer is α-hydroxy-α-methyl-dithio-phenyl acetic acid ethylester.

5. Method according to claim 1, in which the silver halide of the emulsion is a mixture of silver chloride and silver bromide, the silver bromide constituting up to 50 mol % of the total silver content of the emulsion.

* * * * *